US008150702B2

(12) United States Patent
Zhou et al.

(10) Patent No.: US 8,150,702 B2
(45) Date of Patent: Apr. 3, 2012

(54) STEREO AUDIO ENCODING DEVICE, STEREO AUDIO DECODING DEVICE, AND METHOD THEREOF

(75) Inventors: Jiong Zhou, Singapore (SG); Kok Seng Chong, Singapore (SG)

(73) Assignee: Panasonic Corporation, Osaka (JP)

( * ) Notice: Subject to any disclaimer, the term of this patent is extended or adjusted under 35 U.S.C. 154(b) by 540 days.

(21) Appl. No.: 12/376,000

(22) PCT Filed: Aug. 2, 2007

(86) PCT No.: PCT/JP2007/065132

§ 371 (c)(1),
(2), (4) Date: Mar. 6, 2009

(87) PCT Pub. No.: WO2008/016097

PCT Pub. Date: Feb. 7, 2008

(65) Prior Publication Data

US 2009/0299734 A1 Dec. 3, 2009

(30) Foreign Application Priority Data

Aug. 4, 2006 (JP) ..... 2006-213634
Jun. 14, 2007 (JP) ..... 2007-157759

(51) Int. Cl.
*G10L 21/04* (2006.01)
*G10L 19/00* (2006.01)

(52) U.S. Cl. ..... 704/503; 704/218; 704/220; 704/500

(58) Field of Classification Search ..... None
See application file for complete search history.

(56) References Cited

U.S. PATENT DOCUMENTS 6,356,211 B1 3/2002 Shimoyoshi et al.
6,629,078 B1 * 9/2003 Grill et al. ..... 704/500
2002/0154041 A1 10/2002 Suzuki et al.
2002/0198615 A1 12/2002 Suzuki
2005/0157884 A1 7/2005 Eguchi
(Continued)

FOREIGN PATENT DOCUMENTS

JP 11-32399 2/1999
(Continued)

OTHER PUBLICATIONS

ISO/IEC 14496-3, Second edition, Amendment 2, Information Technology—Coding of Audio Visual Objects—Part 3: Audio, Amendment 2: Parametric coding for high-quality audio, pp. 48-50.

(Continued)

*Primary Examiner* — Matthew Sked
(74) *Attorney, Agent, or Firm* — Greenblum & Bernstein, P.L.C.

(57) ABSTRACT

Disclosed is a stereo audio encoding device capable of improving a spatial image of a decoded audio in stereo audio encoding. In this device, an original cross correlation calculation unit (101) calculates a mutual relationship coefficient ($C_1$) between the original L channel signal and the original R channel signal. A stereo audio reconfiguration unit (104) subjects the inputted L channel signal and the R channel signal to encoding and decoding so as to generate an L channel reconfigured signal (L') and an R channel reconfigured signal (R'). A reconfiguration cross correlation calculation unit (105) calculates a cross correlation coefficient ($C_2$) between the L channel reconfigured signal (L') and the R channel reconfigured signal (R'). A cross correlation comparison unit (106) calculates and outputs a comparison result &agr; between the cross correlation coefficient ($C_1$) and the cross correlation coefficient ($C_2$).

11 Claims, 10 Drawing Sheets

U.S. PATENT DOCUMENTS

| | | | | |
|---|---|---|---|---|
| 2007/0299669 | A1 | 12/2007 | Ehara | |
| 2008/0091419 | A1 | 4/2008 | Yoshida et al. | |
| 2008/0177533 | A1 | 7/2008 | Teo et al. | |
| 2008/0281587 | A1 | 11/2008 | Yoshida | |
| 2009/0018824 | A1 | 1/2009 | Teo | |
| 2009/0076809 | A1* | 3/2009 | Yoshida | 704/219 |

FOREIGN PATENT DOCUMENTS

| | | |
|---|---|---|
| JP | 2002-244698 | 8/2002 |
| JP | 2002-344325 | 11/2002 |
| JP | 2004-325633 | 11/2004 |
| JP | 2005-202248 | 7/2005 |
| JP | 2005-523480 | 8/2005 |
| WO | 2006/070751 | 7/2006 |

OTHER PUBLICATIONS

ISO/IEC 23003-1: 2006 (E), Information Technology—MPEG Audio Technologies—Part 1: MPEG Surround, p. 243, (ISO/IEC FDIS 23003-1: 2006 (E)).

ISO/IEC 23003-1: 2007(E), Information Technology—MPEG Audio Technologies—Part 1: MPEG Surround, p. 250.

* cited by examiner

STEREO AUDIO ENCODING DEVICE, STEREO AUDIO DECODING DEVICE, AND METHOD THEREOF

TECHNICAL FIELD

The present invention relates to a stereo speech coding apparatus, stereo speech decoding apparatus and methods used in conjunction with these apparatuses, used upon coding and decoding of stereo speech signals in mobile communications systems or in packet communications systems utilizing the Internet protocol (IP).

BACKGROUND ART

In mobile communications systems and in packet communications systems utilizing IP, advancement in the rate of digital signal processing by DSPs (Digital Signal Processors) and enhancement of bandwidth have been making possible high bit rate transmissions. If the transmission rate continues increasing, bandwidth for transmitting a plurality of channels can be secured (i.e. wideband), so that, even in speech communications where monophonic technologies are popular, communications based on stereophonic technologies (i.e. stereo communications) is anticipated to become more popular. In wideband stereophonic communications, more natural sound environment-related information can be encoded, which, when played on headphones and speakers, evokes spatial images the listener is able to perceive.

As a technology for encoding spatial information included in stereo audio signals, there is binaural cue coding (BCC). In binaural cue coding, the coding end encodes a monaural signal that is generated by synthesizing a plurality of channel signals constituting a stereo audio signal, and calculates and encodes the cues between the channel signals (i.e. inter-channel cues). Inter-channel cues refer to side information that is used to predict channel signal from a monaural signal, including inter-channel level difference (ILD), inter-channel time difference (ITD) and inter-channel correlation (ICC). The decoding end decodes the coding parameters of a monaural signal and acquires a decoded monaural signal, generates a reverberant signal of the decoded monaural signal, and reconstructs stereo audio signals using the decoded monaural signal, its reverberant signal and inter-channel cues.

Thus, non-patent document 1 and non-patent document 2 are presented as examples disclosing techniques of encoding spatial information included in stereo audio signals. FIG. 1 is a block diagram showing primary configurations in stereo audio coding apparatus 100 disclosed in non-patent document 1. Referring to FIG. 1, monaural signal generating section 11 generates a monaural signal (M) using the L channel signal and R channel signal constituting a stereo audio signal received as input, and outputs the monaural signal (M) generated, to monaural signal coding section 12. Monaural signal coding section 12 generates monaural signal coded parameters by encoding the monaural signal generated in monaural signal generation section 11, and outputs the monaural signal coded parameters to multiplexing section 14. Inter-channel cue calculation section 13 calculates the inter-channel cues between the L channel signal and R channel signal received as input, including ILD, ITD and ICC, and outputs the inter-channel cues to multiplexing section 14. Multiplexing section 14 multiplexes the monaural signal coded parameters received as input from monaural signal coding section 12 and the inter-channel cues received as input from inter-channel cue calculation section 13, and outputs the resulting bit stream to stereo audio decoding apparatus 20.

FIG. 2 is a block diagram showing primary configurations in stereo audio decoding apparatus 20 disclosed in non-patent document 1. Referring to FIG. 2, separation section 21 performs separation processing with respect to a bit stream that is transmitted from stereo audio coding apparatus 10, outputs the monaural signal coded parameters acquired, to monaural signal decoding section 22, and outputs the inter-channel cues acquired, to first cue synthesis section 24 and second cue synthesis section 25. Monaural signal decoding section 22 performs decoding processing using the monaural signal coded parameters received as input from separation section 21, and outputs the decoded monaural signal acquired, to allpass filter 23, first cue synthesis section 24 and second cue synthesis section 25. Allpass filter 23 delays the decoded monaural signal received as input from monaural signal decoding section 22 by a predetermined period, and outputs the monaural reverberant signal ($M_{Rev}'$) generated, to first cue synthesis section 24 and second cue synthesis section 25. First cue synthesis section 24 performs decoding processing using the inter-channel cues received as input from separation section 21, the decoded monaural signal received as input from monaural signal decoding section 22 and the monaural reverberant signal received as input from allpass filter 23, and outputs the decoded L channel signal (L') acquired. Second cue synthesis section 25 performs decoding processing using the inter-channel cues received as input from separation section 21, the decoded monaural signal received as input from monaural signal decoding section 22 and the monaural reverberant signal received as input from allpass filter 23, and outputs the decoded R channel signal (R') acquired.

Now, conventional mobile telephones already feature multimedia players with stereo functions and FM radio functions. In addition to this, fourth-generation mobile telephones and IP telephones are anticipated to have additional functions for recording and playing stereo speech signals.

Non-Patent Document 1: ISO/IEC 14496-3: 2005 Part 3 Audio, 8.6.4 Parametric stereo Non-Patent Document 2: ISO/IEC 23003-1: 2006/FCD MPEG Surround (ISO/IEC 23003-1: 2007 Part1 MPEG Surround)

DISCLOSURE OF INVENTION

Problems to be Solved by the Invention

When a stereo audio signal is encoded, three inter-channel cues, namely ILD, ITD and ICC, are calculated and encoded. By contrast with this, when stereo speech is encoded, only two inter-channel cues, namely ILD and ITD, are encoded. ICC is important spatial information included in stereo speech signals, and, if stereo speech is generated in the decoding end without utilizing ICC, the stereo speech lacks spatial images. It necessarily follows that, to improve the spatial images of decoded stereo signals, a configuration for encoding ILD, ITD, and, in addition, spatial information, needs to be introduced in stereo speech coding.

It is therefore an object of the present invention to provide a stereo speech coding apparatus, stereo speech decoding apparatus and methods to be used with these apparatuses, to improve the spatial images of decoded speech in stereo speech coding. Means for Solving the Problem[0009] The stereo speech coding apparatus according to the present invention employs a configuration including: a first calculation section that calculates a first cross-correlation coefficient between a first channel signal and a second channel signal constituting stereo speech; a stereo speech reconstruction section that generates a first channel reconstruction signal and a second channel reconstruction signal using the first channel signal and the second channel signal; a second calculation section that calculates a second cross-correlation coefficient between the first channel reconstruction signal and the second channel reconstruction signal; and a comparison section that acquires a cross-correlation comparison result comprising spatial information of the stereo speech by comparing the first cross-correlation coefficient and the second cross-correlation coefficient.

The stereo speech decoding apparatus according to the present invention employs a configuration including: a separation section that acquires, from a bit stream that is received as input, a first parameter and a second parameter, related to a first channel signal and a second channel signal, respectively, the first channel signal and the second channel signal being generated in a coding apparatus and constituting stereo speech, and a cross-correlation comparison result that is acquired by comparing a first cross-correlation between the first channel signal and the second channel signal and a second cross-correlation between a first channel reconstruction signal and a second channel reconstruction signal generated using the first channel signal and the second channel signal, the cross-correlation comparison result comprising spatial information related to the stereo speech; a stereo speech decoding section that generates a decoded first channel reconstruction signal and a decoded second channel reconstruction signal using the first parameter and the second parameter; a stereo reverberant signal generation section that generates a first channel reverberant signal using the decoded first channel reconstruction signal and generates a second channel reverberant signal using the decoded second channel reconstruction signal; a first spatial information recreation section that generates a first channel decoded signal using the decoded first channel reconstruction signal, the first channel reverberant signal and the cross-correlation comparison result; and a second spatial information recreation section that generates a second channel decoded signal using the decoded second channel reconstruction signal, the second channel reverberant signal and the cross-correlation comparison result.

Advantageous Effect of the Invention

According to the present invention, in stereo speech signal coding, it is possible to improve spatial images of decoded stereo speech signals by comparing two cross-correlation coefficients as spatial information related to inter-channel cross-correlation (ICC) and transmitting the comparison result to the stereo decoding end.

BEST MODE FOR CARRYING OUT THE INVENTION

Now, embodiments of the present invention will be described below in detail.

In the embodiments below, cases will be described as examples where a stereo speech signal is comprised of the left ("L") channel and the right ("R") channel. The stereo speech coding apparatus of each embodiment calculates the cross-correlation coefficient $C_1$ between the original L channel signal and R channel signal received as input. Furthermore, in each embodiment, the stereo speech coding apparatus is provided with a local stereo speech reconstruction section, and reconstructs the L channel signal and the R channel signal and calculates the cross-correlation coefficient $C_2$ between the reconstructed L channel signal and R channel signal. In each embodiment, the stereo speech coding apparatus compares the cross-correlation coefficient $C_1$ and cross-correlation coefficient $C_2$, and transmits the comparison result $\alpha$ to the stereo speech decoding apparatus as spatial information included in stereo speech signals.

Embodiment 1

Figure 1:
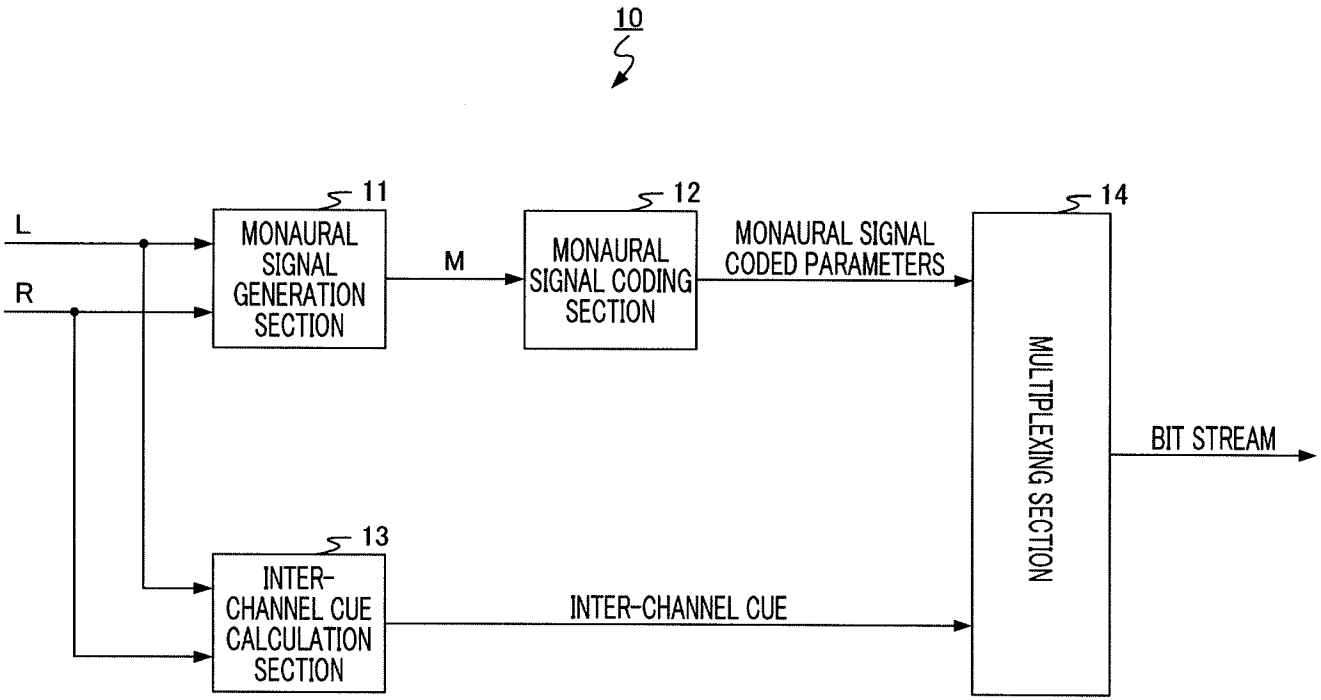
FIG.1 Prior Art
FIG. 1 is a block diagram showing primary configurations in a stereo audio coding apparatus according to prior art.
Figure 2:
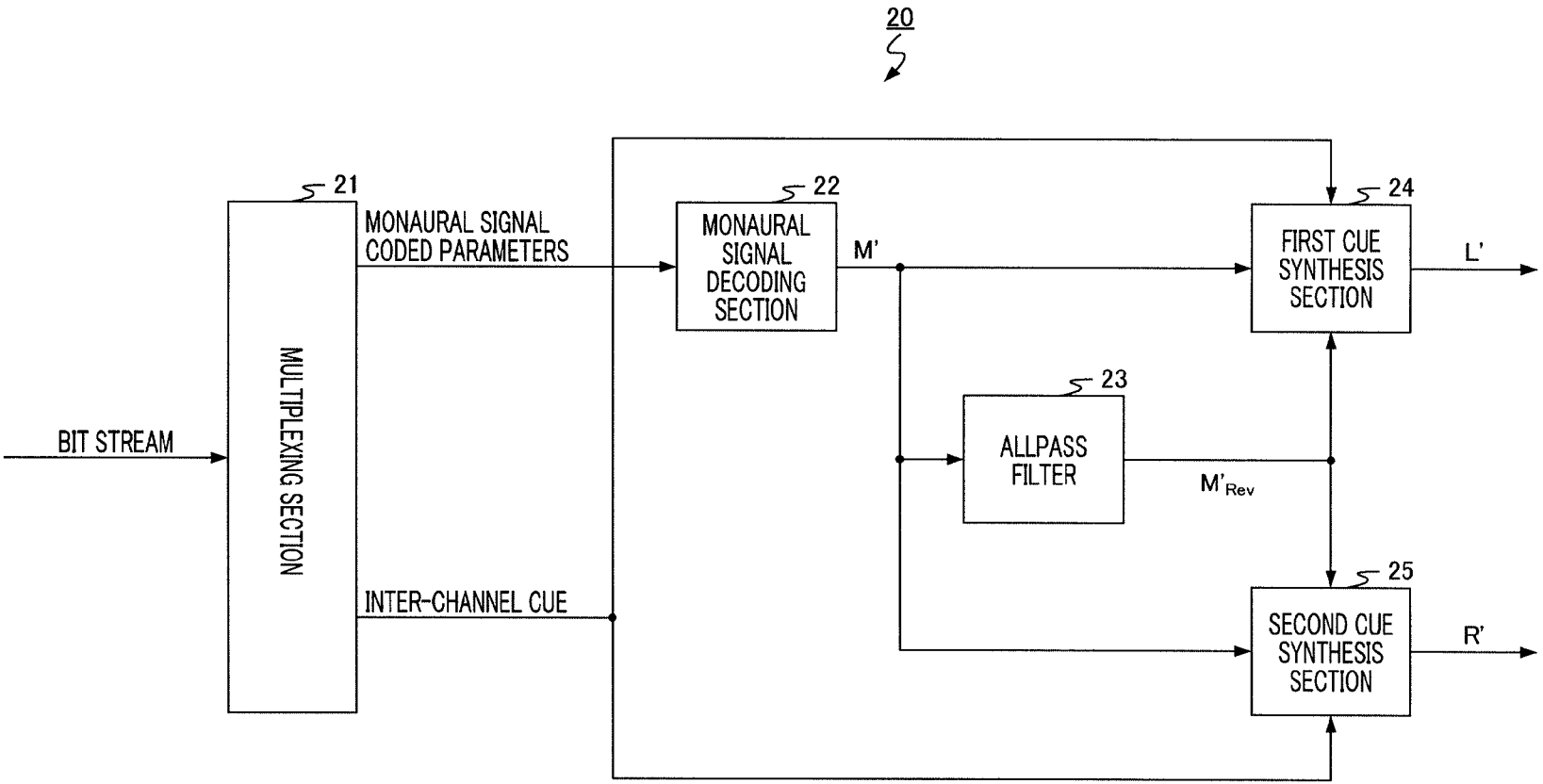
FIG.2 Prior Art
FIG. 2 is a block diagram showing primary configurations in a stereo audio decoding apparatus according to prior art.
Figure 3:
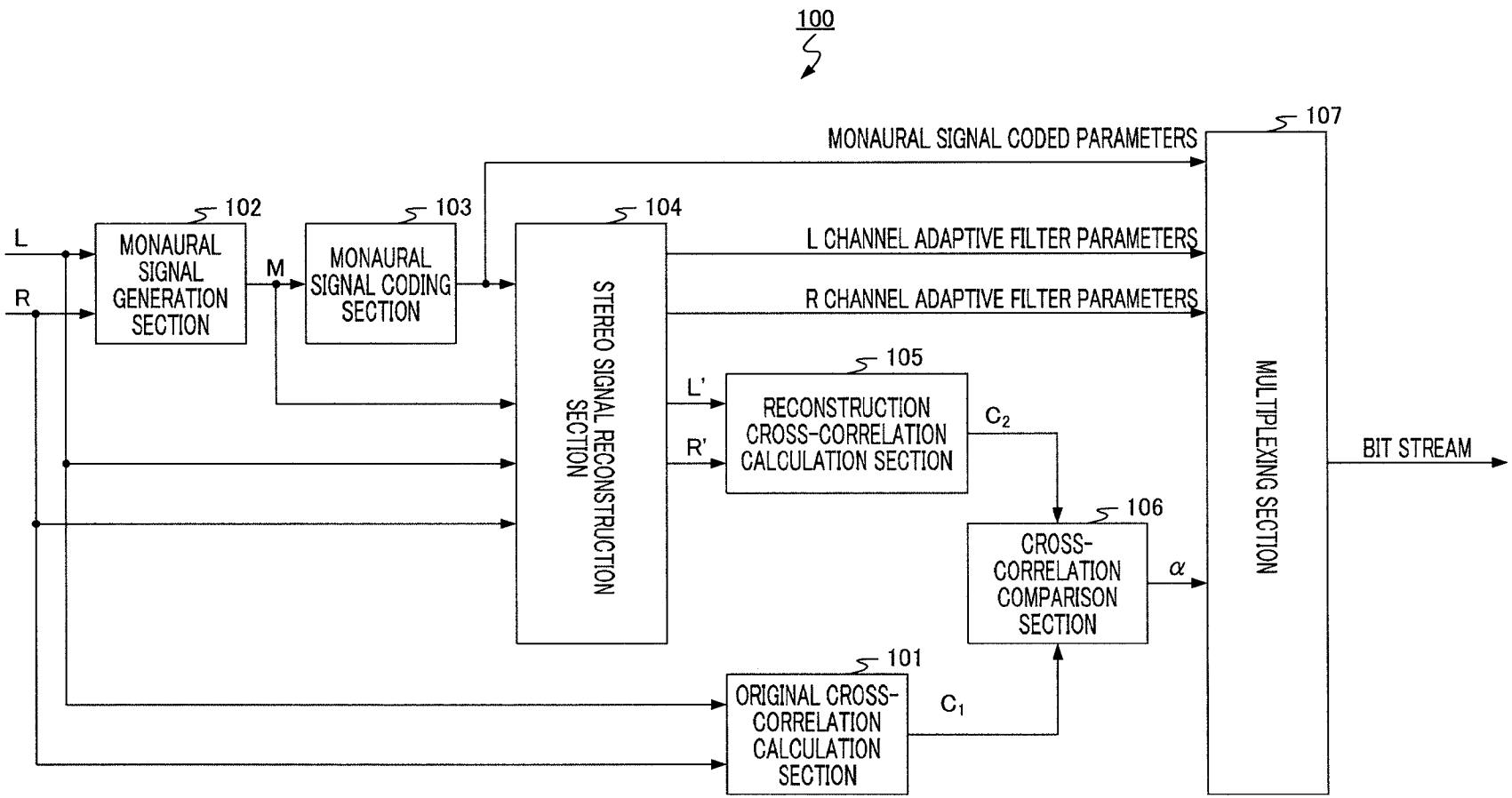
FIG. 3 is a block diagram showing primary configurations in a stereo speech coding apparatus according to embodiment 1 of the present invention.

FIG. 3 is a block diagram showing primary configurations in stereo speech coding apparatus 100 according to embodiment 1 of the present invention. Stereo speech coding apparatus 100 performs stereo speech coding processing of a stereo signal received as input, using the L channel signal and the R channel signal, and transmits the resulting bit stream to stereo speech decoding apparatus 200 (described later). Stereo speech decoding apparatus 200, which supports stereo speech coding apparatus 100, outputs a decoded signal of either a monaural signal or stereo signal, so that monaural/stereo scalable coding is made possible.

Original cross-correlation calculation section 101 calculates the cross-correlation coefficient $C_1$ between the original L channel signal (L) and R channel signal (R) constituting a stereo speech signal, according to equation 1 below, and outputs the result to cross-correlation comparison section 106.

(Equation 1)

$$C_1 = \frac{\sum_n L(n)R(n)}{\sqrt{\sum_n L(n)^2 \sum_n R(n)^2}} \quad [1]$$

where n is the sample number in the time domain;

L(n) is the L channel signal,

R(n) is the R channel signal, and $C_1$ is the cross-correlation coefficient between the L channel signal and the R channel signal.

Monaural signal generation section 102 generates a monaural signal (M) using the L channel signal (L) and R channel signal (R) according to, for example, equation 2 below, and outputs the monaural signal (M) generated, to monaural signal coding section 103 and stereo speech reconstruction section 104.

(Equation 2)

$$M(n) = \frac{1}{2}[L(n) + R(n)] \quad [2]$$

where n is the sample number in the time domain,

L(n) is the L channel signal,

R(n) is the R channel signal, and

M(n) is the monaural signal.

Monaural signal coding section 103 performs speech coding processing such as AMR-WB (Adaptive MultiRate-WideBand) with respect to the monaural signal received as input from monaural signal generation section 102, and outputs the monaural signal coded parameters generated, to stereo speech reconstruction section 104 and multiplexing section 104.

Stereo speech reconstruction section 104 encodes the L channel signal (L) and the R channel signal (R) using the monaural signal (M) received as input from monaural signal generation section 102, and outputs the L channel adaptive filter parameters and R channel adaptive filter parameters generated, to multiplexing section 107. Also, stereo speech reconstruction section 104 performs decoding processing using the acquired L channel adaptive filter parameters, R channel adaptive filter parameters and the monaural signal coded parameters received as input from monaural signal coding section 103, and outputs the L channel reconstruction signal (L') and the R channel reconstruction signal (R') generated, to reconstruction cross-correlation calculation section 105. Incidentally, stereo speech reconstruction section 104 will be described later in detail.

Reconstruction cross-correlation calculation section 105 calculates the cross-correlation coefficient $C_2$ between the L channel reconstruction signal (L') and R channel reconstruction signal (R') received as input from stereo speech reconstruction section 104, according to equation 3 below, and outputs the result to cross-correlation comparison section 106.

(Equation 3)

$$C_2 = \frac{\sum_n L'(n)R'(n)}{\sqrt{\sum_n L'(n)^2 \sum_n R'(n)^2}} \quad [3]$$

where n is the sample number in the time domain,

L(n) is the L channel reconstruction signal,

R(n) is the R channel reconstruction signal, and $C_2$ is the cross-correlation coefficient between the L channel reconstruction signal and the R channel reconstruction signal.

Cross-correlation comparison section 106 compares the cross-correlation coefficient $C_1$ received as input from original cross-correlation calculation section 101 and the cross-correlation coefficient $C_2$ received as input from reconstruction cross-correlation calculation section 105, according to equation 4 below, and outputs the cross-correlation comparison result $\alpha$ to multiplexing section 107.

(Equation 4)

$$\alpha = \sqrt{\frac{C_1}{C_2}} \quad [4]$$

where $C_1$ is the cross-correlation coefficient between the L channel signal and the R channel signal;

$C_2$ is the cross-correlation coefficient between the L channel reconstruction signal and the R channel reconstruction signal; and $\alpha$ is the cross-correlation comparison result.

The cross correlation value $C_2$ between reconstructed stereo signals is usually higher than cross correlation value $C_1$ between the original stereo signals. In this case, $C_2$ is greater than $C_1$ and $|\alpha| \leqq 1$ holds, so that the parameters are suitable for quantization and transmission.

Multiplexing section 107 multiplexes the monaural signal coded parameters received as input from monaural signal coding section 103, the L channel adaptive filter parameters and R channel adaptive filter parameters received as input from stereo speech reconstruction section 104, and the cross-correlation comparison result $\alpha$ received as input from cross-correlation comparison section 106, and outputs the resulting bit stream to stereo speech decoding apparatus 200.

Figure 4:
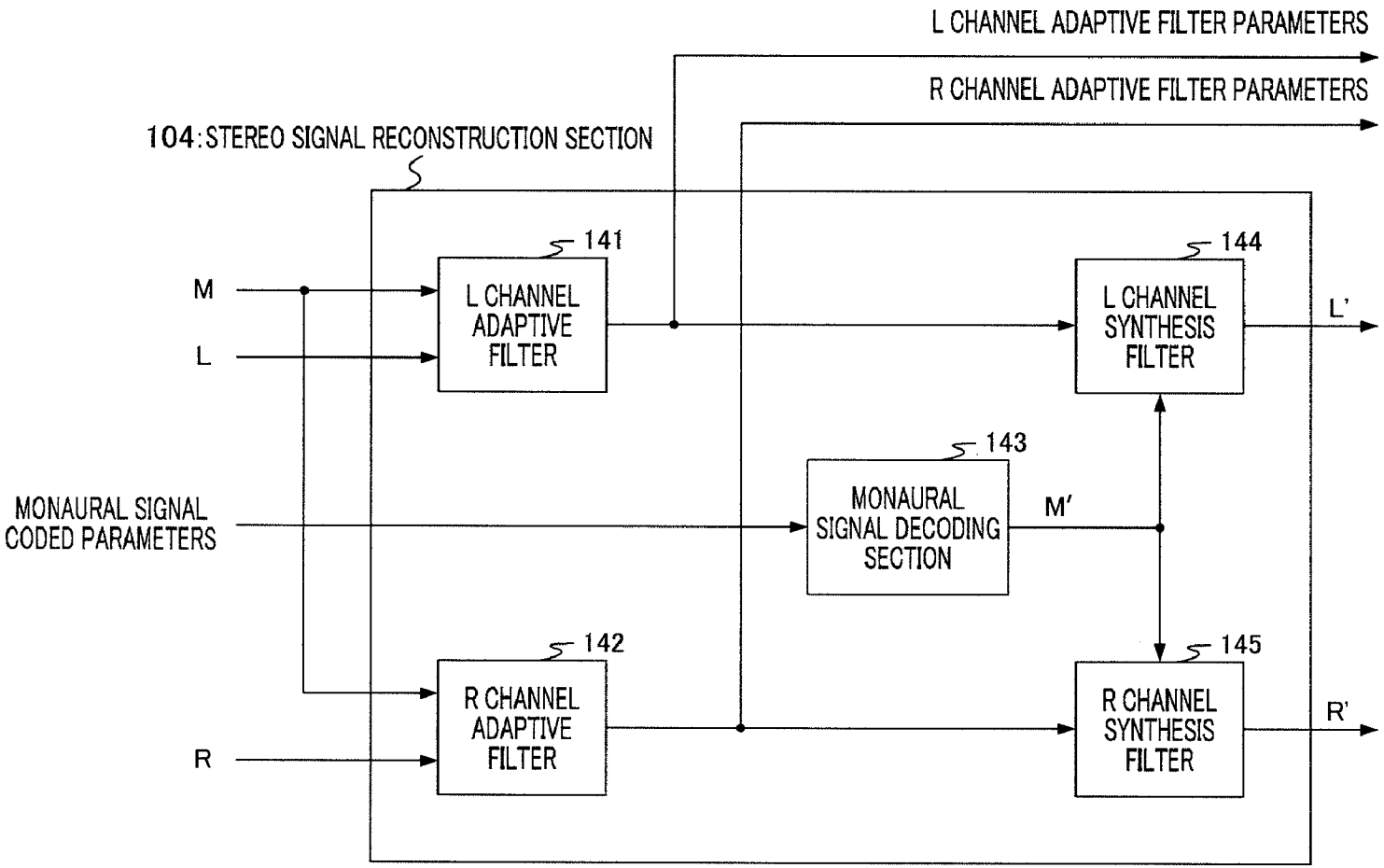
FIG. 4 is a block diagram showing primary configurations inside a stereo speech reconstruction section according to embodiment 1 of the present invention.

FIG. 4 is a block diagram showing primary configurations inside stereo speech reconstruction section 104.

L channel adaptive filter 141 is comprised of an adaptive filter, and, using the L channel signal (L) and the monaural signal (M) received as input from monaural signal generation section 102, as the reference signal and the input signal, respectively, finds adaptive filter parameters that minimize the mean square error between the reference signal and the input signal, and outputs these parameters to L channel synthesis filter 144 and multiplexing section 107. The adaptive filter parameters determined in L channel adaptive filter 141 will be herein after referred to as "L channel adaptive filter parameters."

R channel adaptive filter 142 is comprised of an adaptive filter, and, using the R channel signal (R) and the monaural signal (M) received as input from monaural signal generation section 102, as the reference signal and the input signal, respectively, finds adaptive filter parameters that minimize the mean square error between the reference signal and the input signal, and outputs these parameters to R channel synthesis filter 145 and multiplexing section 107. The adaptive filter parameters determined in R channel adaptive filter 142 will be herein after referred to as "R channel adaptive filter parameters."

Monaural signal decoding section 143 performs speech decoding processing such as AMR-WB with respect to the monaural signal coded parameters received as input from monaural signal coding section 103, and outputs the decoded monaural signal (M') generated, to L channel synthesis filter 144 and R channel synthesis filter 145.

L channel synthesis filter 144 performs decoding processing with respect to the decoded monaural signal (M') received as input from monaural signal decoding section 143, by way of filtering by the L channel adaptive filter parameters received as input from L channel adaptive filter 141, and outputs the L channel reconstruction signal (L') generated, to reconstruction cross-correlation calculation section 105.

R channel synthesis filter 145 performs decoding processing with respect to the decoded monaural signal (M') received as input from monaural signal decoding section 143, by way of filtering by the R channel adaptive filter parameters received as input from R channel adaptive filter 142, and outputs the R channel reconstruction signal (R') generated, to reconstruction cross-correlation calculation section 105.

Figure 5:
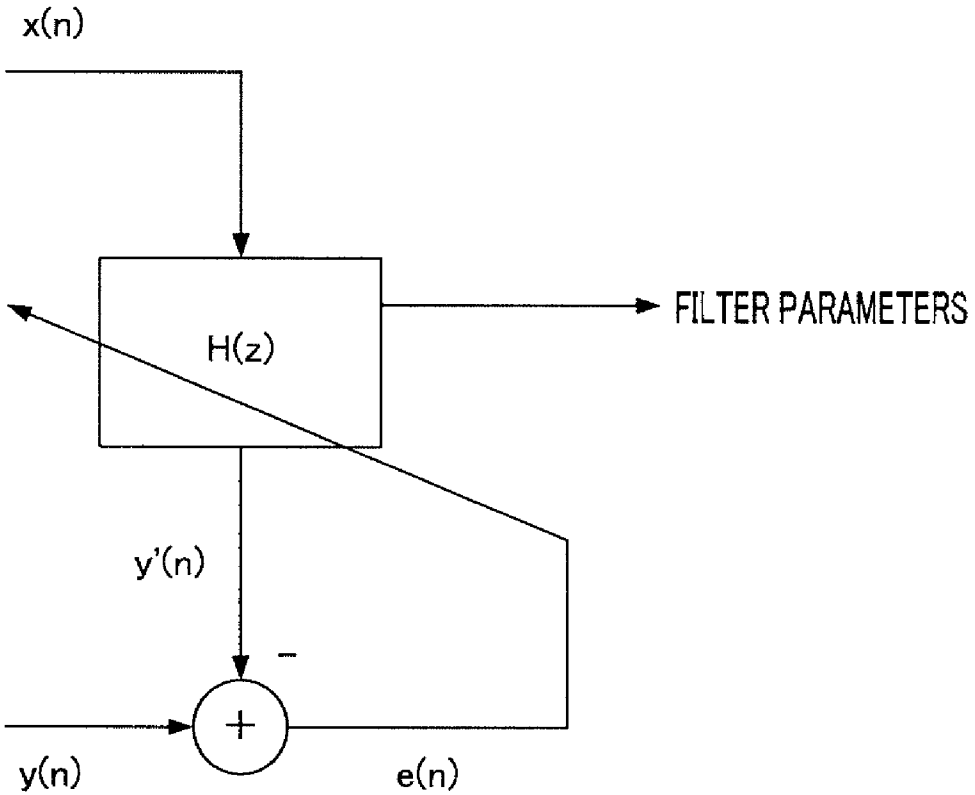
FIG. 5 shows the configuration and operations of an adaptive filter according to embodiment 1 of the present invention.

FIG. 5 explains by way of illustration the configuration and operation of an adaptive filter constituting L channel adaptive filter 141. In this drawing, n is the sample number in the time domain. H(z) is $H(z)=b_0+b_1(z^{-1})+b_2(z^{-2})+\ldots+b_k(z^{-k})$ and represents an adaptive filter (e.g. FIR (Finite Impulse Response)) model (i.e. transfer function) Here, k is the order of the adaptive filter parameters, and $b=[b_0, b_1, \ldots, b_k]$ is the adaptive filter parameters. Furthermore, x(n) is the input signal in the adaptive filter, and, for L channel adaptive filter 141, the monaural signal (M) received as input from monaural signal generation section 102 is used. Also, y(n) is the reference signal for the adaptive filter, and, with L channel adaptive filter 141, the L channel signal (L) is used.

The adaptive filter finds and outputs adaptive filter parameters $b=[b_0, b_1, \ldots, b_k]$ that minimize the mean square error between the reference signal and the input signal, according to equation 5 below.

(Equation 5)

$$\begin{aligned} MSE(b) &= E\{[e(n)]^2\} \\ &= E\{[y(n)-y'(n)]^2\} \\ &= E\left\{\left[y(n)-\sum_{i=0}^{k} b_i x(n-i)\right]^2\right\} \end{aligned} \quad [5]$$

In this equation, E is the statistical expectation operator, e(n) is the prediction error, and k is the filter order.

The configuration and operations of the adaptive filter constituting R channel adaptive filter 142 are the same as the adaptive filter constituting L channel adaptive filter 141. The adaptive filter constituting R channel adaptive filter 142 is different from the adaptive filter constituting L channel adaptive filter 141 in receiving as input the R channel signal (R) as the reference signal y(n).

Figure 6:
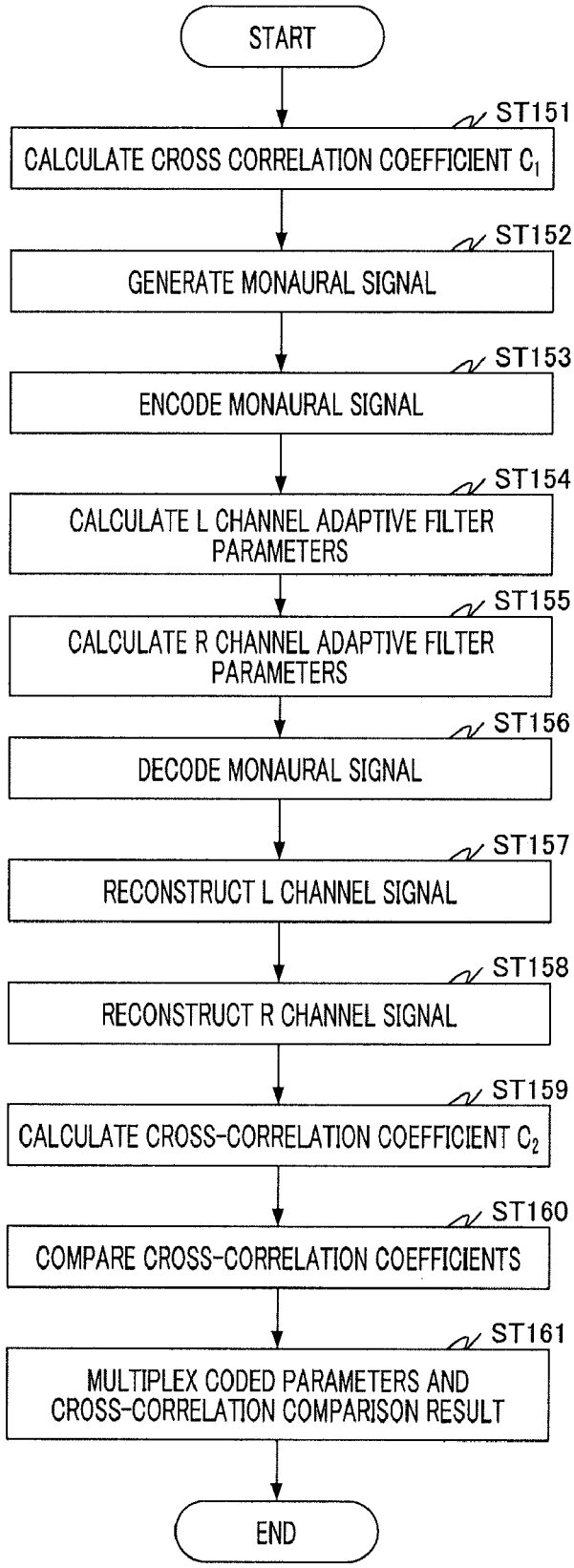
FIG. 6 is a flowchart showing an example of steps in stereo speech coding processing in a stereo speech coding apparatus according to embodiment 1 of the present invention.

FIG. 6 is a flowchart showing an example of steps in stereo speech coding processing in stereo speech coding apparatus 100.

First, in step (herein after simply "ST") 151, original cross-correlation calculation section 101 calculates the cross-correlation coefficient $C_1$ between the original L channel signal (L) and R channel signal (R).

Next, in ST 152, monaural signal generation section 102 generates a monaural signal using the L channel signal and R channel signal.

Next, in ST 153, monaural signal coding section 103 encodes the monaural signal and generates monaural signal coded parameters.

Next, in ST 154, L channel adaptive filter 141 finds L channel adaptive filter parameters that minimize the mean square error between the L channel signal and the monaural signal.

Next, in ST 155, R channel adaptive filter 142 finds R channel adaptive filter parameters that minimize the mean square error between the R channel signal and the monaural signal.

Next, in ST 156, monaural signal decoding section 143 performs decoding processing using the monaural signal coded parameters, and generates a decoded monaural signal (M').

Next, in ST 157, L channel synthesis filter 144 reconstructs the L channel signal using the decoded monaural signal (M') and the L channel adaptive filter parameters, and generates an L channel reconstruction signal (L').

Next, in ST 158, using the decoded monaural signal (M') and the R channel adaptive filter parameters, R channel synthesis filter 145 reconstructs the R channel signal and generates an R channel reconstruction signal (R').

Next, in ST 159, reconstruction cross-correlation calculation section 105 calculates the cross-correlation coefficient $C_2$ between the L channel reconstruction signal (L') and the R channel reconstruction signal (R').

Next, in ST 160, cross-correlation comparison section 106 compares the cross-correlation coefficient $C_1$ and the cross-correlation coefficient $C_2$, and finds the cross-correlation comparison result $\alpha$.

Next, in ST 161, multiplexing section 107 multiplexes the monaural signal coded parameters, L channel adaptive filter parameters, R channel adaptive filter parameters and cross-correlation comparison result $\alpha$, and outputs the result.

As described above, stereo speech coding apparatus 100 transmits the adaptive filter parameters found in L channel adaptive filter 141 and in R channel adaptive filter 142 to stereo speech decoding apparatus 200, as spatial information parameters related to inter-channel level difference (ILD) and inter-channel time difference (ITD). Furthermore, stereo speech coding apparatus 100 transmits to stereo speech decoding apparatus 200 the cross-correlation comparison result $\alpha$ found in cross-correlation comparison section 106 as spatial information parameters related to inter-channel cross-correlation (ICC) between the L channel signal and the R channel signal.

Incidentally with the present embodiment, stereo speech coding apparatus 100 may transmit the cross-correlation coefficient $C_1$ between the original L channel signal (L) and R channel signal (R), instead of the cross-correlation comparison result $\alpha$. In this case, it is still possible to determine the cross-correlation coefficient $C_2$ between the L channel reconstruction signal (L') and the R channel reconstruction signal (R') in the decoder end, so that the cross-correlation comparison result $\alpha$ can be calculated in the decoder end. By this means, in stereo speech coding apparatus 100, it is no longer necessary to generate reconstruction signals of the L channel and R channel, so that the amount of calculations can be reduced.

Figure 7:
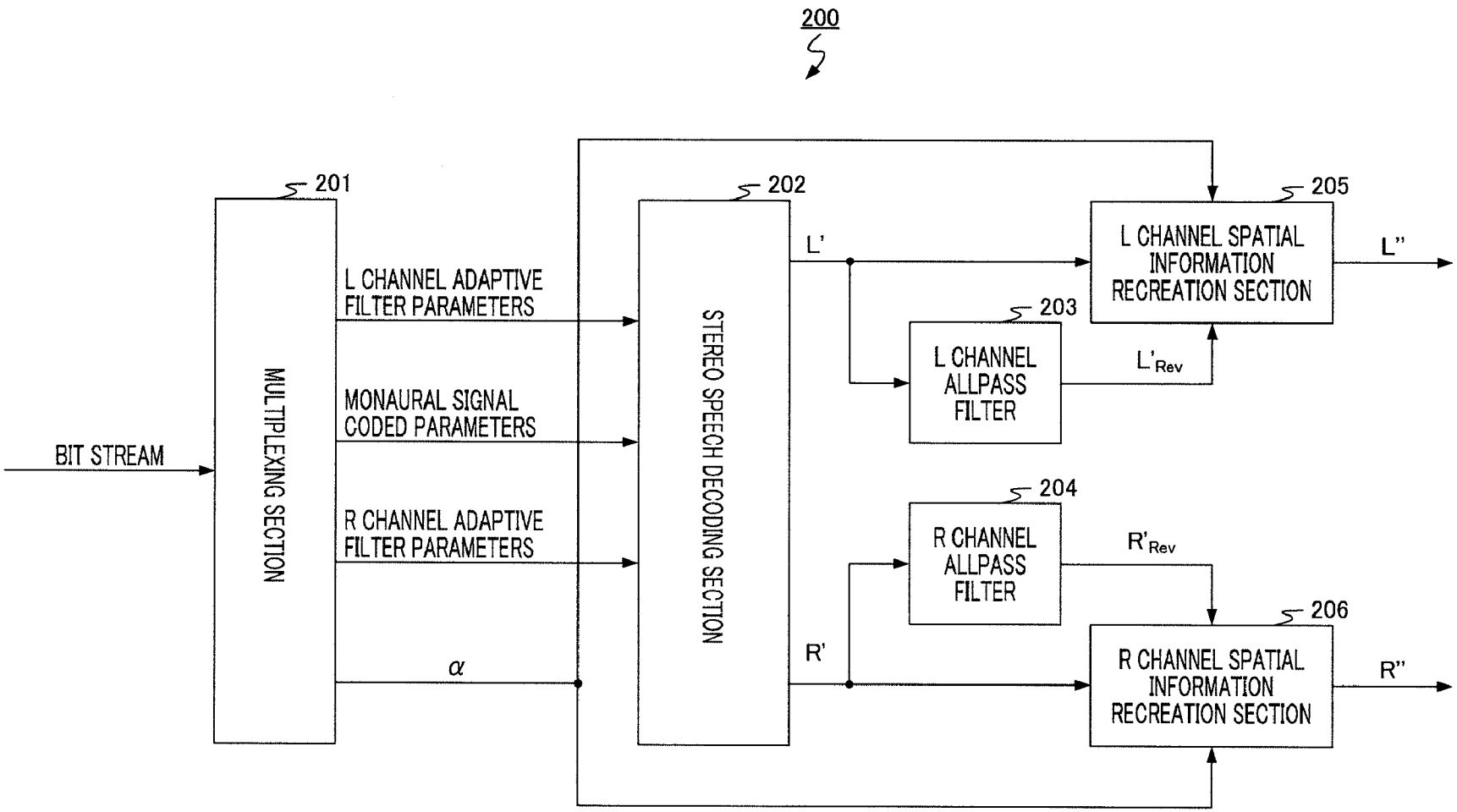
FIG. 7 is a block diagram showing primary configurations in a stereo speech decoding apparatus according to embodiment 1 of the present invention.

FIG. 7 is a block diagram showing primary configurations in stereo speech decoding apparatus 200.

Separation section 201 performs separation processing with respect to a bit stream received as input from stereo speech coding apparatus 100, outputs the monaural signal coded parameters, L channel adaptive filter parameters and R channel adaptive filter parameters to stereo speech decoding section 202, and outputs the cross-correlation comparison result $\alpha$ to L channel spatial information recreation section 205 and R channel spatial information recreation section 206.

Using the monaural signal coded parameters, L channel adaptive filter parameters and R channel adaptive filter parameters received as input from separation section 201, stereo speech decoding section 202 decodes the L channel signal and R channel signal, and outputs the L channel reconstruction signal (L') generated, to L channel allpass filter 203 and L channel spatial information recreation section 205. Stereo speech decoding section 202 outputs the R channel reconstruction signal (R') acquired by decoding, to R channel allpass filter 204 and R channel spatial information recreation section 206. Incidentally, stereo speech decoding section 202 will be described later in detail.

L channel allpass filter 203 generates an L channel reverberant signal ($L'_{Rev}$) using allpass filter parameters representing the transfer function shown below in equation 6 and the L channel reconstruction signal (L') received as input from stereo speech decoding section 202, and outputs the L channel reverberant signal ($L'_{Rev}$) to L channel spatial information recreation section 205.

(Equation 6)

$$H_{allpass} = \frac{a_N + a_{N-1}z^{-1} + \ldots + a_1 z^{-(N-1)} + z^{-N}}{1 + a_1 z^{-1} + \ldots + a_{N-1} z^{-(N-1)} + a_N z^{-N}} \quad [6]$$

In this equation, $H_{allpass}$ is the transfer function of the allpass filter, $a=[a_1, a_2, \ldots, a_N]$ is the allpass filter parameters, and N is the order of the allpass filter parameters. The input signal L' in L channel allpass filter 203 and the output signal $L'_{Rev}$ are orthogonal to each other, so that the cross-correlation value between them is $[L'(n), L'_{Rev}(n)]=0$. The energy of L' and the energy of $L'_{Rev}$ are the same, that is, $|L'(n)|^2=|L'_{Rev}(n)|^2$.

R channel allpass filter 204 generates an R channel reverberant signal ($R'_{Rev}$) using the allpass filter parameters representing the transfer function shown above in equation 6 and the R channel reconstruction signal (R') received as input from stereo speech decoding section 202, and outputs the R channel reverberant signal ($R'_{Rev}$) to R channel spatial information recreation section 206.

L channel spatial information recreation section 205 calculates and outputs a decoded L channel signal (L") using the cross-correlation comparison result α received as input from separation section 201, the L channel reconstruction signal (L') received as input from stereo speech decoding section 202, and the L channel reverberant signal ($L'_{Rev}$) received as input from L channel allpass filter 203, according to equation 7 below.

[7]

$$L''=\alpha L'+\sqrt{(1-\alpha^2)}L'_{Rev} \quad \text{(Equation 7)}$$

R channel spatial information recreation section 206 calculates and outputs a decoded R channel signal (R") using the cross-correlation comparison result α received as input from separation section 201, the R channel reconstruction signal (R') received as input from stereo speech decoding section 202, and the R channel reverberant signal ($R'_{Rev}$) received as input from R channel allpass filter 204, according to equation 8 below.

[8]

$$R''=\alpha R'+\sqrt{(1-\alpha^2)}R'_{Rev} \quad \text{(Equation 8)}$$

As mentioned above, L' and $L'_{Rev}$ are orthogonal to each other and have the same energy, so that the energy of the decoded L channel signal (L") can be given by equation 9 below. Likewise, the energy of the decoded R channel signal (R") can be given by equation 10 below.

[9]

$$|L''|^2=|\alpha L'|^2+|\sqrt{1-\alpha^2}L_{Rev}|^2+2\alpha\sqrt{1-\alpha^2}L'L_{Rev}=|L'|^2=|L_{Rev}|^2 \quad \text{(Equation 9)}$$

[10]

$$|R''|^2=|R''|^2=|R_{Rev}|^2 \quad \text{(Equation 10)}$$

Furthermore, the numerator term of the cross-correlation value $C_3$ between the decoded L channel signal (L") and the decoded R channel signal (R") is given by equation 11 below. When different filters are used for L channel allpass filter 203 and R channel allpass filter 204, the signals in the second to fourth terms in the right part of equation 11 are virtually orthogonal to each other, so that the second to fourth terms are substantially small compared to the first term and therefore practically can be regarded as zero. Therefore, following equations 4, 9, 10 and 11, the cross-correlation value $C_3$ between the decoded L channel signal (L") and decoded R channel signal (R") becomes equal to the cross-correlation coefficient $C_1$ between the original L channel signal (L) and R channel signal (R), as shown with equation 12 below. It follows from above that, by calculating decoded signals in L channel spatial information recreation section 205 and R channel spatial information recreation section 206, using the cross-correlation comparison result α, according to equation 7 and equation 8, it is possible to acquire decoded signals of two channels in such a way that the cross-correlation value between the two channels is equal to the original cross-correlation value.

[11]

$$L''\cdot R''=\alpha^2(L'\cdot R')+\alpha\sqrt{(1-\alpha^2)}(L'\cdot R'_{Rev})+\alpha\sqrt{(1-\alpha^2)}(L'_{Rev}\cdot R')+(1-\alpha^2)(L'_{Rev}\cdot R'_{Rev}) \quad \text{(Equation 11)}$$

(Equation 12)

$$C_3 = \frac{\sum_n L''(n)R''(n)}{\sqrt{\sum_n L''(n)^2 \sum_n R''(n)^2}} = \alpha^2 C_2 = C_1 \quad [12]$$

Figure 8:
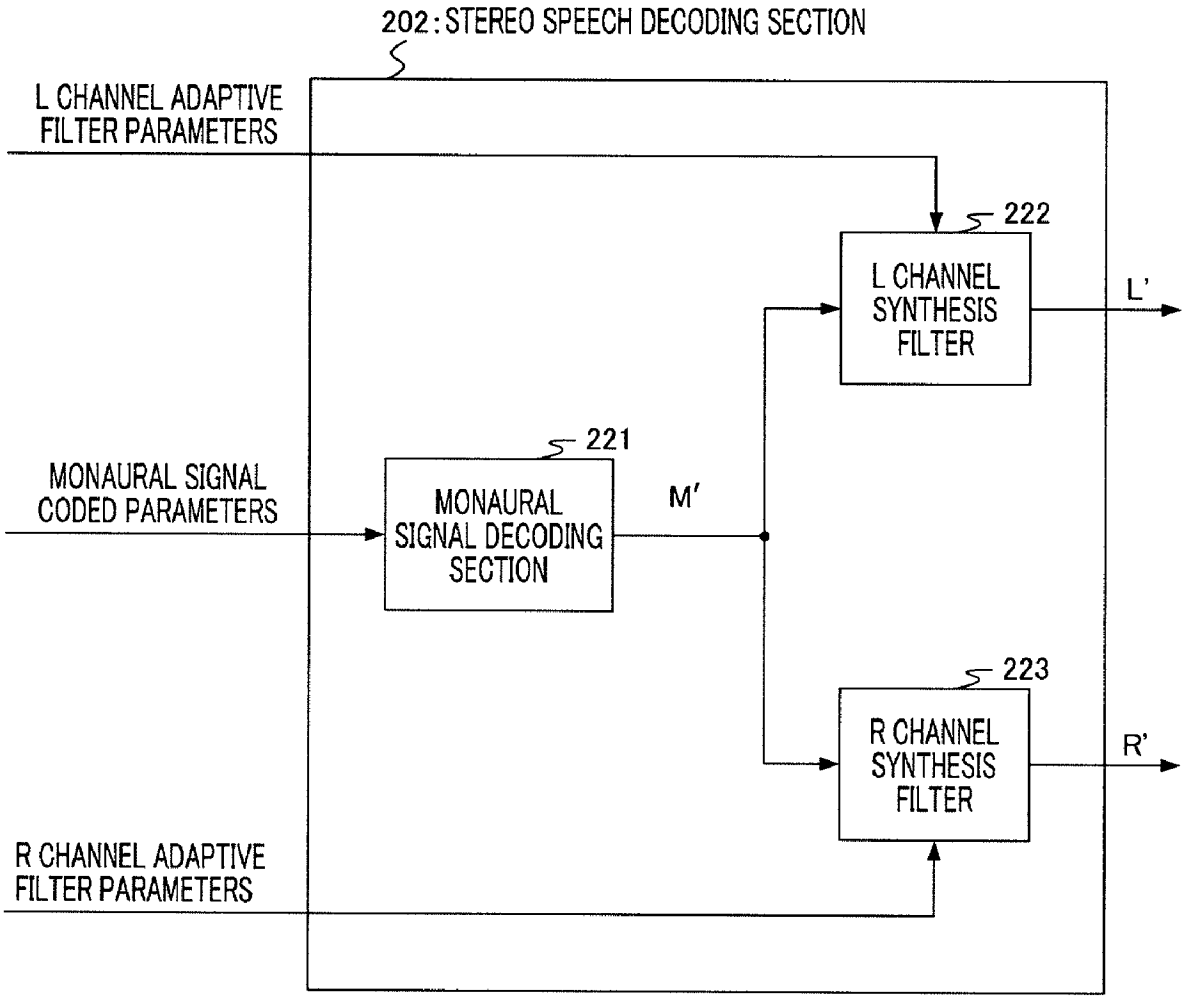
FIG. 8 is a block diagram showing primary configurations inside a stereo speech decoding section according to embodiment 1 of the present invention.

FIG. 8 is a block diagram showing primary configurations inside stereo speech decoding section 202.

Monaural signal decoding section 221 performs decoding processing using the monaural signal coded parameters received as input from separation section 201, and outputs the decoded monaural signal (M') generated, to L channel synthesis filter 222 and R channel synthesis filter 223.

L channel synthesis filter 222 performs decoding processing with respect to the decoded monaural signal (M') received as input from monaural signal decoding section 221, by way of filtering by the L channel adaptive filter parameters received as input from separation section 201, and outputs the L channel reconstruction signal (L') generated, to L channel allpass filter 203 and L channel spatial information recreation section 205.

R channel synthesis filter 223 performs decoding processing with respect to the decoded monaural signal (M') received as input from monaural signal decoding section 221, by way of filtering by the R channel adaptive filter parameters received as input from separation section 201, and outputs the R channel reconstruction signal (R') generated, to R channel allpass filter 204 and R channel spatial information recreation section 206.

Figure 9:
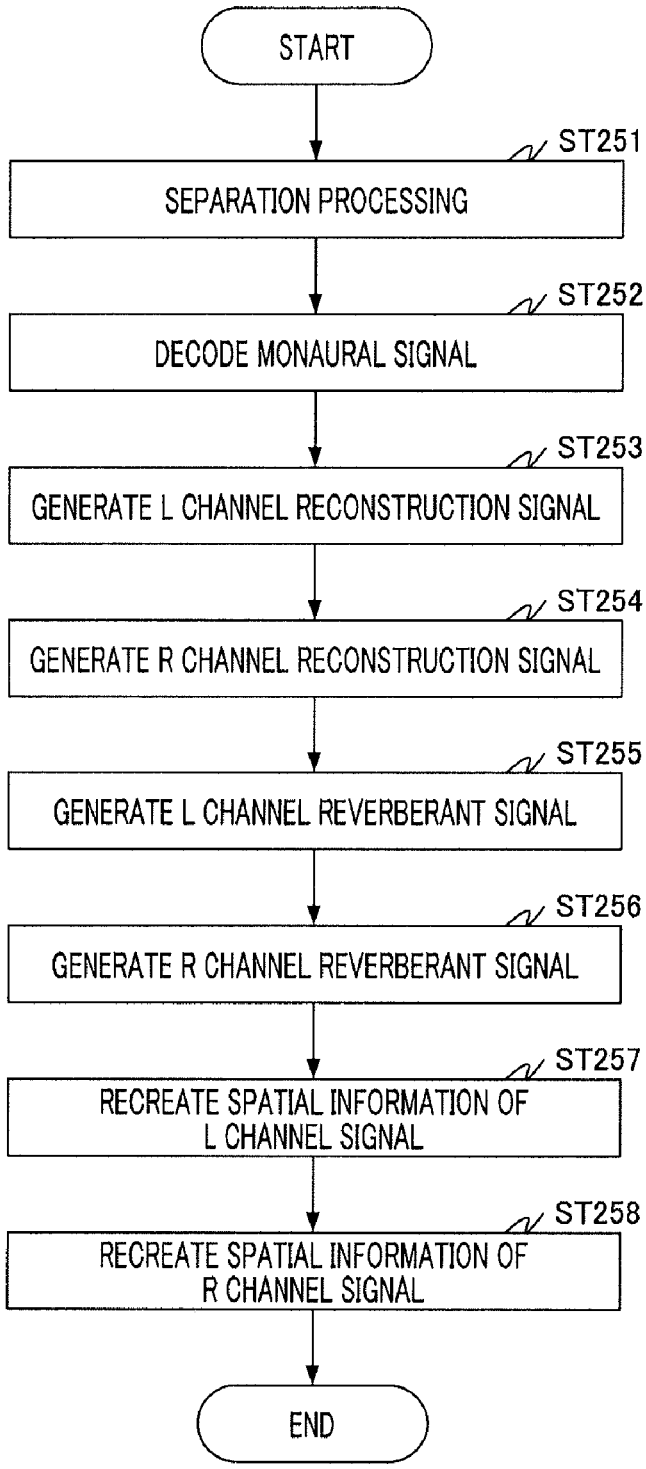
FIG. 9 is a flowchart showing an example of steps in stereo speech decoding processing in a stereo speech decoding apparatus according to embodiment 1 of the present invention.

FIG. 9 is a flowchart showing an example of steps in the stereo speech decoding processing in stereo speech decoding apparatus 200.

First, in ST 251, separation section 201 performs separation processing using a bit stream received as input from stereo speech coding apparatus 100, and generates monaural signal coded parameters, L channel adaptive filter parameters, R channel adaptive filter parameters and cross-correlation comparison result α.

Next, in ST 252, monaural signal decoding section 221 decodes the monaural signal using the monaural signal coded parameters, and generates a decoded monaural signal (M').

Next, in ST 253, L channel synthesis filter 222 performs decoding processing by way of filtering by the L channel adaptive filter parameters with respect to the decoded monaural signal (M'), and generates an L channel reconstruction signal (L').

Next, in ST 254, R channel synthesis filter 223 performs decoding processing by way of filtering by the R channel adaptive filter parameters with respect to the decoded monaural signal (M'), and generates an R channel reconstruction signal (R').

Next, in ST 255, L channel allpass filter 203 generates an L channel reverberant signal ($L'_{Rev}$) using the L channel reconstruction signal (L').

Next, in ST 256, R channel allpass filter 204 generates an R channel reverberant signal ($R'_{Rev}$) using the R channel reconstruction signal (R').

Next, in ST 257, L channel spatial information recreation section 205 generates a decoded L channel signal (L") using the L channel reconstruction signal (L'), L channel reverberant signal ($L'_{Rev}$) and cross-correlation comparison result α.

Next, in ST 258, R channel spatial information recreation section 206 generates a decoded R channel signal (R") using the R channel reconstruction signal (R'), R channel reverberant signal ($R'_{Rev}$) and cross-correlation comparison result α.

Thus, according to the present embodiment, stereo speech coding apparatus 100 transmits L channel adaptive filter parameters and R channel adaptive filter parameters, which are spatial information parameters related to inter-channel level difference (ILD) and inter-channel time difference (ITD), and transmits, in addition, cross-correlation comparison result α, which is spatial information related to inter-channel cross-correlation (ICC), to stereo speech decoding apparatus 200. Then, in the stereo speech decoding apparatus, stereo speech decoding is performed using these information, so that spatial images of decoded speech can be improved.

Although an example of a case has been described above with the present embodiment where L channel adaptive filter parameters and L channel adaptive filter parameters are found and transmitted as spatial information related to the inter-channel level difference (ILD) and inter-channel time difference (ITD), the present invention is by no means limited to this, and other spatial information parameters representing inter-channel difference information than L channel adaptive filter parameters and R channel adaptive filter parameters may be used as well.

Furthermore, although an example of a case has been described above with the present embodiment where a cross-correlation comparison result is found according to equation 4 above in cross-correlation comparison section 106, the present invention is by no means limited to this, and it is equally possible to find other comparison results that uniquely specify the difference between the cross-correlation coefficient $C_1$ and the cross-correlation coefficient $C_2$.

Furthermore, although an example of a case has been described above with the present embodiment where an L channel reverberant signal ($L'_{Rev}$) and R channel reverberant signal ($R'_{Rev}$) are generated using fixed allpass filter parameters in L channel allpass filter 203 and R channel allpass filter 204, it is equally possible to use allpass filter parameters transmitted from stereo speech coding apparatus 100.

Furthermore, referring to FIG. 6 and FIG. 9, although an example has been described above with the present embodiment where the processings in the individual steps are executed in a serial fashion, there are steps that can be reordered or parallelized. For example, although an example of a case has been described above where L channel adaptive filter parameters are calculated in ST 154 and R channel adaptive filter parameters are calculated in ST 155, it is equally possible to reorder these two steps and calculate R channel adaptive filter parameters in ST 154 and calculate L channel adaptive filter parameters in ST 155 or even carry out the processings in ST 154 and ST 155 in parallel. Furthermore, the monaural signal decoding carried out in ST 156 may be performed before ST 154 or before ST 155 or may be carried out in parallel with ST 154 and ST 155. Similarly, the order of ST 157 and ST 158, the order of ST 253 and ST 254, the order of ST 255 and ST 256, and the order of ST 257 and ST 258 may be reordered or may be parallelized. In addition, ST 151 may be carried out any time between the start and ST 159.

Furthermore, referring to FIG. 7 and FIG. 8, although an example of a case has been described above with the present embodiment where the decoded monaural signal (M') generated in monaural signal decoding section 221 is not outputted to outside stereo speech decoding apparatus 200, the present invention is by no means limited to this and, for example, it is equally possible to output the decoded monaural signal (M') to outside stereo speech decoding apparatus 200 and use decoded monaural signal (M') as decoded speech in stereo speech decoding apparatus 200 when the generation of the Decoded L channel signal (L") or Decoded R channel signal (R") fails.

Furthermore, although an example of a case has been described above with the present embodiment where stereo speech reconstruction section 104 in stereo speech coding apparatus generates an L channel reconstruction signal (L') and R channel reconstruction signal (R') by using L channel adaptive filter parameters and R channel adaptive filter parameters that are obtained by encoding the L channel signal (L) and R channel signal (R) using a monaural signal (M) for both channels, and a decoded monaural signal (M') that is obtained by performing decoding processing using monaural signal coded parameters received as input from monaural signal coding section 103, the present invention is by no means limited to this, and it is equally possible to acquire an L channel reconstruction signal (L') and R channel reconstruction signal (R') by performing coding processing and decoding processing for each of the L channel signal and R channel signal, without using a monaural signal (M) and monaural signal coded parameters. In this case, the stereo speech coding apparatus needs not have monaural signal generation section 102 and monaural signal coding section 103. Furthermore, in this case, L channel coding parameters and R channel coding parameters are generated from the coding processing of the L channel signal (L) and R channel signal (R) in the stereo speech reconstruction section, instead of L channel adaptive filter parameters and R channel adaptive filter parameters. Consequently, a bit stream that is outputted from this stereo speech coding apparatus needs not contain monaural signal coded parameters.

Furthermore, a stereo speech decoding apparatus to support this stereo speech coding apparatus would adopt a configuration not using monaural signal coded parameters in stereo speech decoding apparatus 200 shown in FIG. 7. That is to say, when a bit stream does not contain monaural signal coded parameters, monaural signal coded parameters are not outputted from separation section 201. Furthermore, it is equally possible not to provide monaural signal decoding section 221 in the stereo speech decoding section 202, and, instead, acquire an L channel reconstruction signal (L') and R channel reconstruction signal (R') by performing the same decoding processing as the decoding processing performed in the stereo speech reconstruction section in the counterpart stereo speech coding apparatus, with respect to the L channel coding parameters and R channel coding parameters.

Embodiment 2

Although a configuration has been described above with embodiment 1 where an L channel reverberant signal ($L'_{Rev}$) and R channel reverberant signal ($R'_{Rev}$) are used to generate decoded signals of the L channel and R channel in the decoding end, the present invention is by no means limited to this, and it is equally possible to employ a configuration using a monaural reverberant signal instead of an L channel reverberant signal ($L'_{Rev}$) and R channel reverberant signal ($R'_{Rev}$). The configuration and operations in this case will be described below in detail with embodiment 2.

The configuration and operations of the stereo speech coding apparatus according to the present embodiment are the same as in embodiment 1 except for the operation of cross-correlation comparison section 106 shown in FIG. 3. In cross-correlation comparison section 106 according to the present embodiment, the cross-correlation comparison result α is determined according to equation 13, instead of equation 4.

(Equation 13)

$$\alpha = \sqrt{\frac{C_1 + 1}{C_2 + 1}} \quad [13]$$

where $C_1$ is the cross-correlation coefficient between the L channel signal and the R channel signal, $C_2$ is the cross-correlation coefficient between the L channel reconstruction signal and the R channel reconstruction signal, and α is the cross-correlation comparison result.

Figure 10:
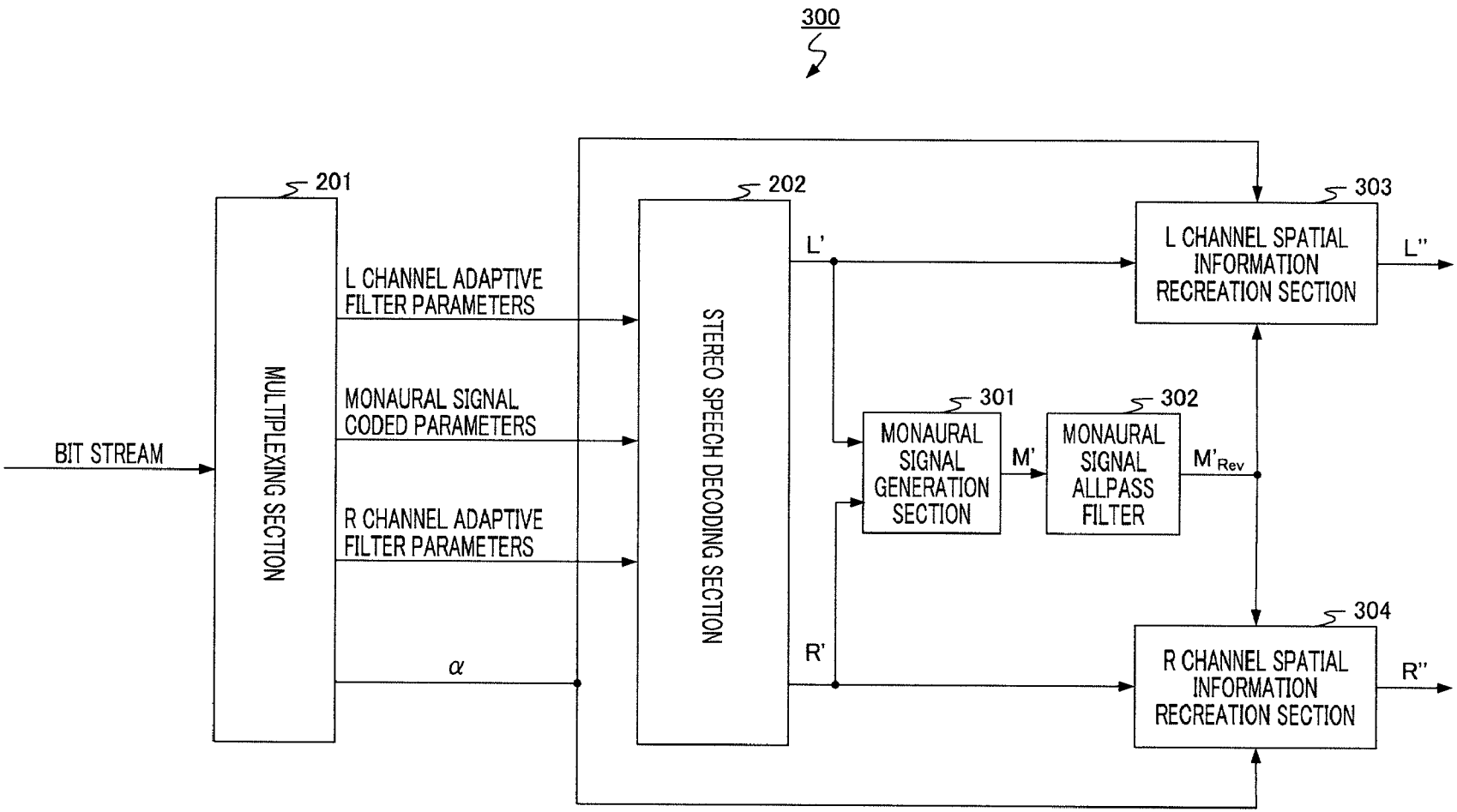
FIG. 10 is a block diagram showing primary configurations in a stereo speech decoding apparatus according to embodiment 2 of the present invention.

FIG. 10 is a block diagram showing primary configurations in stereo speech decoding apparatus 300 according to the present embodiment. The configurations and operations of separation section 201 and stereo speech decoding section 202 are the same as the configurations and operations of separation section 201 and stereo speech decoding section 202 of stereo speech decoding apparatus 200 shown in FIG. 7, described with embodiment 1, and therefore will not be described again.

Monaural signal generation section 301 calculates and outputs a monaural reconstruction signal (M') using an L channel reconstruction signal (L') and R channel reconstruction signal (R') received as input from stereo speech decoding section 202. The monaural reconstruction signal (M') is calculated in the same way as by the algorithm for a monaural signal (M) in monaural signal generation section 102.

Monaural signal allpass filter 302 generates a monaural reverberant signal ($M'_{Rev}$) using allpass filter parameters and the monaural reconstruction signal (M') received as input from monaural signal generation section 301, and outputs the monaural reverberant signal ($M'_{Rev}$) to L channel spatial information recreation section 303 and R channel spatial information recreation section 304. Here, the allpass filter parameters are represented by the transfer function shown in equation 6, similar to the L channel allpass filter 203 and R channel allpass filter 204 of embodiment 1 shown in FIG. 7. L channel spatial information recreation section 303 calculates and outputs an Decoded L channel signal (L"), according to equation 14 below, using the cross-correlation comparison result α received as input from separation section 201, the L channel reconstruction signal (L') received as input from stereo speech decoding section 202 and the monaural reverberant signal ($M'_{Rev}$) received as input from monaural signal allpass filter 302.

(Equation 14)

$$L'' = \alpha L' + \sqrt{(1-\alpha^2)}\sqrt{\frac{|L'|^2}{|M'_{Rev}|^2}}\,M'_{Rev} \quad [14]$$

In a similar manner, R channel spatial information recreation section 304 calculates and outputs an Decoded R channel signal (R") according to equation 15 below, using the cross-correlation comparison result α received as input from separation section 201, the R channel reconstruction signal (R') received as input from stereo speech decoding section 202 and the monaural reverberant signal ($M'_{Rev}$) received as input from monaural signal allpass filter 302.

(Equation 15)

$$R'' = \alpha R' - \sqrt{(1-\alpha^2)}\sqrt{\frac{|R'|^2}{|M'_{Rev}|^2}}\,M'_{Rev} \quad [15]$$

Here, L' and $M'_{Rev}$ are virtually orthogonal to each other, so that the energy of the Decoded L channel signal (L") is given by equation 16 below. In a similar fashion, R' and $M'_{Rev}$ are virtually orthogonal to each other, so that the energy of the Decoded R channel signal (R") is given equation 17 below.

(Equation 16)

$$\begin{aligned}|L''|^2 &= \alpha^2|L'|^2 + (1-\alpha^2)|L'|^2 + 2\alpha\sqrt{1-\alpha^2}\,L'\cdot \\ &\quad \sqrt{\frac{|L'|^2}{|M'_{Rev}|^2}}\,M'_{Rev} \\ &= |L'|^2\end{aligned} \quad [16]$$

(Equation 17)

$$|R''|^2 = |R'^2| \quad [17]$$

Furthermore, given the orthogonality between L' and $M'_{Rev}$ and the orthogonality between R' and $M'_{Rev}$, the numerator term of the cross-correlation value $C_3$ between the Decoded L channel signal (L") and the Decoded R channel signal (R") is given by equation 18 below. Consequently, from equations 13, 16, 17, 18, as shown in equation 19, the cross-correlation value $C_3$ between the Decoded L channel signal and Decoded R channel signal becomes equal to the cross-correlation coefficient $C_1$ between the original L channel signal and R channel signal. It follows from above that L channel spatial information recreation section 303 and R channel spatial information recreation section 304 calculate decoded signals by utilizing the cross-correlation comparison result $\alpha$according to equations 14 and 15, so that decoded signals of the two channels are acquired in such a way that the cross-correlation value between the two signals becomes equal to the original cross-correlation value.

[18]

$$L''\cdot R''=\alpha^2(L'\cdot R')-(1-\alpha^2)\sqrt{|L'|^2|R'|^2} \quad \text{(Equation 18)}$$

(Equation 19)

$$C_3=\frac{\sum_n L''(n)R''(n)}{\sqrt{\sum_n L''(n)^2\sum_n R''(n)^2}} \quad [19]$$

$$=\alpha^2C_2-(1-\alpha^2)$$

$$=C_1$$

Thus, with the present embodiment, upon generating decoded signals of the L channel and the R channel in the decoding end, a monaural reverberant signal ($M'_{Rev}$) is used instead of an L channel reverberant signal ($L'_{Rev}$) and R channel reverberant signal ($R'_{Rev}$), so that it is possible to recreate the spatial information contained in the original stereo signals and improve the spatial images of the stereo speech signals.

Furthermore, with the present embodiment, in the decoding end, only a reverberant signal of a monaural signal needs to be generated instead of generating two types of reverberant signals of the L channel and the right channel, so that it is possible to reduce the computational complexity for generating reverberant signals.

Furthermore, although an example of a case has been described above with the present embodiment where a monaural reconstruction signal (M') is generated in monaural signal generating section 301, the present invention is by no means limited to this, and, if stereo speech decoding section 202 employs a configuration featuring a monaural signal decoding section for decoding a monaural signal such as shown in FIG. 8, then it is possible to acquire a monaural reconstruction signal (M') direct by means of stereo speech decoding section 202.

Embodiments of the present invention have been described above.

Although with the above embodiments the left channel has been described as the "L channel" and the right channel as the "R channel," these notations by no means limit their left-right positional relationships.

Furthermore, although the stereo decoding apparatus of each embodiment has been described to receive and process bit streams transmitted from the stereo speech coding apparatus of each embodiment, the present invention is by no means limited to this, and it is equally possible to receive and process bit streams in the stereo speech decoding apparatus of each embodiment above as long as the bit streams transmitted from the coding apparatus can be processed in the decoding apparatus.

Furthermore, the stereo speech coding apparatus and stereo speech decoding apparatus according to the present embodiment can be mounted in communications terminal apparatuses in mobile communications systems, and, by this means, it is possible to provide a communication terminal apparatus that provides the same working effect as described above.

Also, although a case has been described with the above embodiment as an example where the present invention is implemented by hardware, the present invention can also be realized by software as well. For example, the same functions as with the stereo speech coding apparatus according to the present invention can be realized by writing the algorithm of the stereo speech coding method according to the present invention in a programming language, storing this program in a memory and executing this program by an information processing means.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2006-213634, filed on Aug. 4, 2006, and Japanese Patent Application No. 2007-157759, filed on Jun. 14, 2007, including the specifications, drawings and abstracts, are incorporated herein by reference in their entirety.

INDUSTRIAL APPLICABILITY

The stereo speech coding apparatus, stereo speech decoding apparatus and methods used with these apparatuses, according to the present invention, are applicable for use in stereo speech coding and so on in mobile communications terminals.

The invention claimed is:

1. A stereo speech coding apparatus comprising:

a first calculation section that calculates a first cross-correlation coefficient between a first channel signal and a second channel signal constituting stereo speech;

a stereo speech reconstruction section that generates a first channel reconstruction signal and a second channel reconstruction signal using the first channel signal and the second channel signal;

a second calculation section that calculates a second cross-correlation coefficient between the first channel reconstruction signal and the second channel reconstruction signal; and a comparison section that acquires a cross-correlation comparison result comprising spatial information of the stereo speech by comparing the first cross-correlation coefficient and the second cross-correlation coefficient.

2. The stereo speech coding apparatus according to claim 1, wherein:

the first calculation section calculates the first cross-correlation coefficient according to equation 1

$$C_1 = \frac{\sum_n L(n)R(n)}{\sqrt{\sum_n L(n)^2 \sum_n R(n)^2}} \quad \text{(Equation 1)}$$

where n is a sample number in a time domain,

L(n) is the first channel signal,

R(n) is the second channel signal, and $C_1$ is the cross-correlation coefficient between the first channel signal and the second channel signal;

the second calculation section calculates the second cross-correlation coefficient according to equation 2

$$C_2 = \frac{\sum_n L'(n)R'(n)}{\sqrt{\sum_n L'(n)^2 \sum_n R'(n)^2}} \quad \text{(Equation 2)}$$

where n is the sample number in the time domain,

L'(n) is the first channel reconstruction signal,

R'(n) is the second channel reconstruction signal, and $C_2$ is the cross-correlation coefficient between the first channel reconstruction signal and the second channel reconstruction signal; and the comparison section acquires the cross-correlation comparison result according to equation 3

$$\alpha = \sqrt{\frac{C_1}{C_2}} \quad \text{(Equation 3)}$$

where $C_1$ is the cross-correlation coefficient between the first channel signal and the second channel signal, $C_2$ is the cross-correlation coefficient between the first channel reconstruction signal and the second channel reconstruction signal, and $\alpha$ is the cross-correlation comparison result.

3. The stereo speech coding apparatus according to claim 1, further comprising:

a monaural signal generation section that generates a monaural signal using the first channel signal and the second channel signal; and a monaural signal coding section that generates a monaural signal coded parameter by encoding the monaural signal, wherein the stereo speech reconstruction section generates the first channel reconstruction signal and the second channel reconstruction signal by applying the monaural signal and the monaural signal coded parameter to the first channel signal and the second channel signal.

4. The stereo speech coding apparatus according to claim 3, wherein the stereo speech reconstruction section comprises:

a first adaptive filter that finds a first adaptive filter parameter to minimize a mean square error between the monaural signal and the first channel signal;

a second adaptive filter that finds a second adaptive filter parameter to minimize a mean square error between the monaural signal and the second channel signal;

a monaural signal decoding section that generates a decoded monaural signal by decoding the monaural signal using the monaural signal coded parameter;

a first synthesis filter that generates the first channel reconstruction signal by filtering the decoded monaural signal by the first adaptive filter parameter; and a second synthesis filter that generates the second channel reconstruction signal by filtering the decoded monaural signal by the second adaptive filter parameter.

5. A stereo speech decoding apparatus comprising:

a separation section that acquires, from a bit stream that is received as input, a first parameter and a second parameter, related to a first channel signal and a second channel signal, respectively, the first channel signal and the second channel signal being generated in a coding apparatus and constituting stereo speech, and a cross-correlation comparison result that is acquired by comparing a first cross-correlation between the first channel signal and the second channel signal and a second cross-correlation between a first channel reconstruction signal and a second channel reconstruction signal generated using the first channel signal and the second channel signal, the cross-correlation comparison result comprising spatial information related to the stereo speech;

a stereo speech decoding section that generates a decoded first channel reconstruction signal and a decoded second channel reconstruction signal using the first parameter and the second parameter;

a stereo reverberant signal generation section that generates a first channel reverberant signal using the decoded first channel reconstruction signal and generates a second channel reverberant signal using the decoded second channel reconstruction signal;

a first spatial information recreation section that generates a first channel decoded signal using the decoded first channel reconstruction signal, the first channel reverberant signal and the cross-correlation comparison result; and a second spatial information recreation section that generates a second channel decoded signal using the decoded second channel reconstruction signal, the second channel reverberant signal and the cross-correlation comparison result.

6. The stereo speech decoding apparatus according to claim 5, wherein the stereo reverberant signal generation section comprises:

a first allpass filter that generates the first channel reverberant signal by allpass filtering the decoded first channel reconstruction signal; and a second allpass filter that generates the second channel reverberant signal by allpass filtering the decoded second channel reconstruction signal.

7. A stereo speech decoding apparatus comprising:

a separation section that acquires, from a bit stream that is received as input, a first parameter and a second parameter, related to a first channel signal and a second channel signal, respectively, the first channel signal and the second channel signal being generated in a coding apparatus and constituting stereo speech, and a cross-correlation comparison result that is acquired by comparing a first cross-correlation between the first channel signal and the second channel signal and a second cross-correlation between a first channel reconstruction signal and a second channel reconstruction signal generated using the first channel signal and the second channel signal, the cross-correlation comparison result comprising spatial information related to the stereo speech;

a stereo speech decoding section that generates a decoded first channel reconstruction signal and a decoded second channel reconstruction signal using the first parameter and the second parameter;

a monaural reverberant signal generation section that generates a monaural reverberant signal using the decoded first channel reconstruction signal and the decoded second channel reconstruction signal;

a first spatial information recreation section that generates a first channel decoded signal using the decoded first channel reconstruction signal, the monaural reverberant signal and the cross-correlation comparison result; and a second spatial information recreation section that generates a second channel decoded signal using the decoded second channel reconstruction signal, the monaural reverberant signal and the cross-correlation comparison result.

8. The stereo speech decoding apparatus according to claim 7, wherein the monaural reverberant signal generation section comprises:

a monaural signal generation section that generates a monaural reconstruction signal using the decoded first channel reconstruction signal and the decoded second channel reconstruction signal; and a monaural signal allpass filter that generates the monaural reverberant signal by allpass filtering the monaural reconstruction signal.

9. A stereo speech coding method comprising the steps of:

calculating a first cross-correlation coefficient between a first channel signal and a second channel signal constituting stereo speech;

generating a first channel reconstruction signal and a second channel reconstruction signal using the first channel signal and the second channel signal;

calculating a second cross-correlation coefficient between the first channel reconstruction signal and the second channel reconstruction signal; and acquiring a cross-correlation comparison result comprising spatial information of the stereo speech, by comparing the first cross-correlation coefficient and the second cross-correlation coefficient.

10. A stereo speech decoding method comprising the steps of:

acquiring, from a bit stream that is received as input, a first parameter and a second parameter, related to a first channel signal and a second channel signal, respectively, the first channel signal and the second channel signal being generated in a coding apparatus and constituting stereo speech, and a cross-correlation comparison result that is acquired by comparing a first cross-correlation between the first channel signal and the second channel signal and a second cross-correlation between a first channel reconstruction signal and a second channel reconstruction signal generated using the first channel signal and the second channel signal, the cross-correlation comparison result comprising spatial information related to the stereo speech;

generating a decoded first channel reconstruction signal and a decoded second channel reconstruction signal using the first parameter and the second parameter;

generating a first channel reverberant signal using the decoded first channel reconstruction signal and generating a second channel reverberant signal using the decoded second channel reconstruction signal;

generating a first channel decoded signal using the decoded first channel reconstruction signal, the first channel reverberant signal and the cross-correlation comparison result; and generating a second channel decoded signal using the decoded second channel reconstruction signal, the second channel reverberant signal and the cross-correlation comparison result.

11. A stereo speech decoding method comprising the steps of:

acquiring, from a bit stream that is received as input, a first parameter and a second parameter, related to a first channel signal and a second channel signal, respectively, the first channel signal and the second channel signal being generated in a coding apparatus and constituting stereo speech, and a cross-correlation comparison result that is acquired by comparing a first cross-correlation between the first channel signal and the second channel signal and a second cross-correlation between a first channel reconstruction signal and a second channel reconstruction signal generated using the first channel signal and the second channel signal, the cross-correlation comparison result comprising spatial information related to the stereo speech;

generating a decoded first channel reconstruction signal and a decoded second channel reconstruction signal using the first parameter and the second parameter;

generating a monaural reverberant signal using the decoded first channel reconstruction signal and the decoded second channel reconstruction signal;

generating a first channel decoded signal using the decoded first channel reconstruction signal, the monaural reverberant signal and the cross-correlation comparison result; and generating a second channel decoded signal using the decoded second channel reconstruction signal, the monaural reverberant signal and the cross-correlation comparison result.

* * * * *